US005544642A

United States Patent [19]

Guthrie

[11] Patent Number: 5,544,642

[45] Date of Patent: Aug. 13, 1996

[54] MULTIPLE PROJECTILE BLOW GUN MAGAZINE ASSEMBLY

[75] Inventor: Christopher L. Guthrie, Henryville, Ind.

[73] Assignee: G&G Innovations, Inc., Henryville, Ind.

[21] Appl. No.: 503,077

[22] Filed: Jul. 14, 1995

[51] Int. Cl.[6] ..... F41B 1/00; F41B 11/02

[52] U.S. Cl. ..... 124/62; 124/48; 124/59

[58] Field of Search ..... 124/48, 51.1, 59, 124/62, 66, 67

[56] References Cited

U.S. PATENT DOCUMENTS

| | | | |
|---|---|---|---|
| 278,005 | 5/1883 | Fredricks et al. | 124/62 |
| 3,726,266 | 4/1973 | Palmer | 124/59 |
| 3,729,853 | 5/1973 | Critcher | 124/48 X |
| 4,848,307 | 7/1989 | Tsao | 124/59 |
| 4,986,251 | 1/1991 | Lilley | 124/67 |
| 5,186,156 | 2/1993 | Clayton | 124/59 |
| 5,282,455 | 2/1994 | Adamson et al. | 124/59 |

*Primary Examiner*—Eric K. Nicholson

*Assistant Examiner*—John A. Ricci

*Attorney, Agent, or Firm*—Woodard, Emhardt, Naughton Moriarty & McNett Patent and Trademark Attorneys

[57] ABSTRACT

A multi-shot blow gun assembly includes a rotatable dart magazine mounted around a fixed shaft. A proximal end cap is secured to the shaft adjacent the proximal end, and defines a projectile loading aperture and an air input aperture. A distal end cap is secured to the shaft adjacent the distal end, and defines a projectile exit aperture. The projectile magazine is rotably mounted around the shaft between the proximal and distal caps, and defines a number of chambers each configured to receive one of the plurality of projectiles. Selectively revolving the magazine about the shaft aligns each of the number of chambers with the loading aperture to define a corresponding projectile loading path and aligns each of the number of chambers with the input and exit apertures to define a corresponding projectile launching path. A spring-loaded indexer is coupled between an end face of the magazine and one of the proximal and distal caps. The end face includes a number of recesses corresponding to the number of chambers. The indexer includes a finger configured to engage each of the number of recesses to provide a corresponding number of rotational stops.

16 Claims, 4 Drawing Sheets

MULTIPLE PROJECTILE BLOW GUN MAGAZINE ASSEMBLY

BACKGROUND OF THE INVENTION

The present invention relates generally to blow gun devices, and more particularly to improvements in a multi-shot blow gun assembly.

Traditional blow gun devices are simple, tube-like devices into which a single dart is loaded and then fired. Recently, in order to compete with fast-paced activities such as paint ball games, blow gun devices having multiple shot magazines which facilitate loading and sequentially firing of a number of projectiles have been developed. In one such design, a rotary magazine having a number of longitudinal chambers that are loaded by aligning each with a loading aperture and inserting a projectile is used. The magazine is selectively rotated to load remaining empty chambers as desired. Similarly, projectiles are launched by selectively rotating the magazine to align a given loaded chamber with an air input aperture and a projectile exit aperture to form a projectile launching path, and then forcing air into the input aperture.

The rotary magazine of this prior art design is trapped in a cage-like frame between a proximal cap portion and a distal cap portion. The proximal cap defines the air input and loading apertures, and the distal cap defines the exit aperture. Opposing longitudinal arms connect the proximal cap portion and distal cap portions on either of two sides opposing the magazine. This configuration captures each end of the magazine between the proximal cap portion and distal cap portion, respectively, and the opposing longitudinal arms. The magazine rotates within the capturing frame around an axis parallel to the projectile launching path.

Unfortunately, because of the adjacent longitudinal arms, access to the entire periphery of the magazine is not available for manual rotation adjustments. Consequently, this limited access hampers alignment operations. Furthermore, should the longitudinal arms become deformed so that they are "pinched" together, as would occur by continued grasping of the arms, the magazine is likely to bind. Such binding prevents smooth rotation of the magazine.

Another aspect of one existing design is the use of a rotational indexer, particularly a leaf spring attached to one of the longitudinal arms. This leaf spring has a tooth which is biased to ride along the surface of the magazine and is further configured to engage notches spaced along the periphery of this surface. When the tooth engages one of these notches, the force normally required to rotate the magazine must be increased to disengage it. As a result, a rotational stop effectively results. For this configuration, these rotational stops were designed to correspond to a launching path alignment for each of the magazine chambers.

Unfortunately, this rotational indexing scheme has a tendency to score the magazine surface by the tooth riding therealong. Also, the leaf spring structure is exposed in a manner which increases the likelihood of breakage. Moreover, the indexer does not provide rotational stops for alignment of projectile loading paths for each of the magazine chambers.

Consequently, a need exists for a blow gun assembly which provides a multiple projectile magazine fully accessible from all sides for manual rotation. Furthermore, the assembly should provide rotational stops using a sheltered rotational indexer less susceptible to breakage, and offer rotational stops not only for launching path alignments, but also for loading path alignments of each of the chambers contained in the magazine. The present invention addresses these needs.

SUMMARY OF THE INVENTION

Briefly describing one aspect of the present invention, there is provided a blow gun assembly having a multiple projectile magazine which is mounted along a shaft to avoid problems caused by configurations using longitudinal arms. The blow gun assembly is for loading a plurality of projectiles each to be launched by forcing air through the assembly, and comprises a shaft with a proximal end opposing a distal end. A proximal cap is secured to the shaft adjacent the proximal end, and defines a projectile loading aperture and an air input aperture. A distal cap is secured to the shaft adjacent the distal end, and defines a projectile exit aperture. A projectile magazine is rotably mounted around the shaft between the proximal and distal caps. The magazine defines a number of chambers each configured to receive one of the plurality of projectiles.

Selectively revolving the magazine about the shaft aligns each of the number of chambers with the loading aperture to define a corresponding projectile loading path and aligns each of the number of chambers with the input and exit apertures to define a corresponding projectile launching path. In one preferred embodiment the loading and launching paths align simultaneously, unlike existing designs.

In another aspect of the present invention, a new type of rotational indexer is provided which overcomes the problems of the leaf spring indexer configured on a longitudinal arm of existing designs. For this feature, the magazine has an end face defining a number of recesses corresponding to the number of chambers of the magazine. Means for connecting the proximal cap to the distal cap and rotably mounting the magazine between the proximal and distal caps is provided so that each of the number of chambers aligns with the loading aperture to define a projectile loading path and each of the number of chambers aligns with the input and exit apertures to define a projectile launching path when the magazine is selectively rotated. Among the means for connecting the proximal cap and distal cap are a shaft and longitudinal arms.

Unlike existing designs, a spring-loaded indexer is coupled between the end face and one of the proximal and distal caps. The indexer includes a finger configured to engage each of the number of recesses to provide a corresponding number of rotational stops. In one preferred embodiment, each of the number of rotational stops corresponds to alignment of one of the number of chambers with the input and exit apertures. In one embodiment each of the number of rotational stops simultaneously corresponds to alignment of another of the number of chambers with the loading aperture.

Accordingly, it is an object of the present invention to provide a multiple projectile blow gun magazine assembly which permits access around its entire periphery for manual rotation.

Another object of the present invention is provide a rotational indexer which provides rotational stops to index alignment of the launching paths and loading paths for each of the chambers of the magazine.

Other objects, features, and advantages of the present invention shall become apparent from the detailed drawings and descriptions which follow.

DESCRIPTION OF THE PREFERRED EMBODIMENT

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1:
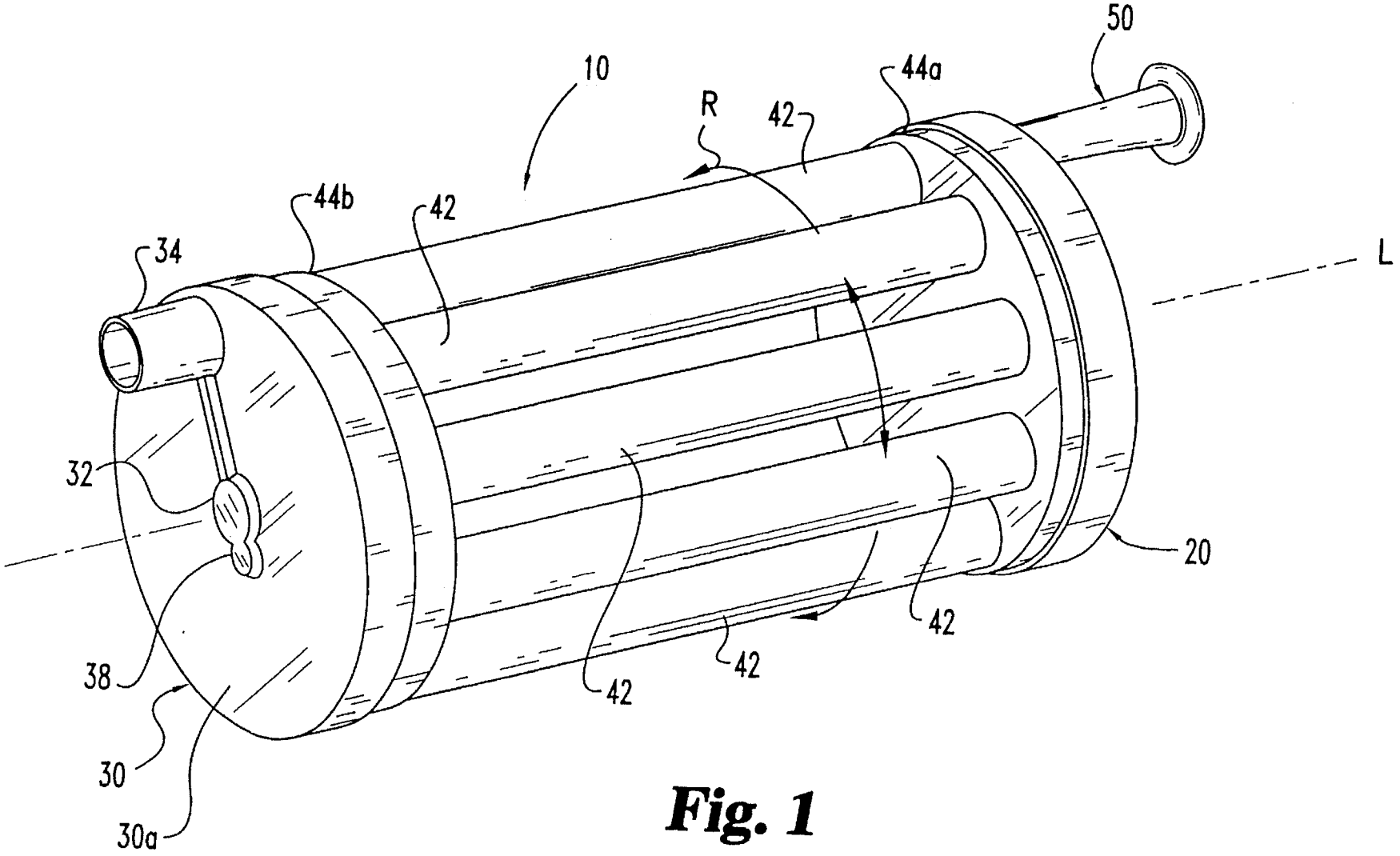
FIG. 1 is a perspective view of one embodiment of the present invention.

Referring to FIG. 1, blow gun assembly 10 of the present invention is illustrated along longitudinal axis L. Blow gun assembly 10 includes a proximal cap 20 opposing a distal cap 30 with a rotary magazine 40 situated therebetween. In addition, blow gun mouthpiece 50 is shown attached to a portion of proximal cap 20. In one preferred embodiment, mouthpiece 50 is manually detachable from the proximal cap 20 and is formed from a thermoplastic compound.

Distal cap 30 includes a muzzle adapter tube 34 extending from an outer distal surface 30*a*. In addition, distal cap 30 includes distal hub 32 and indexer housing 38. In the embodiment shown, hub 32 and housing 38 are formed to result in protrusions from distal outer surface 30*a*. In one preferred embodiment, distal cap 30 and muzzle adapter tube 34 are integrally formed from a single piece of thermoplastic material.

Rotary magazine 40 rotates along path R. Magazine 40 includes a number of dart chambers 42 connected on opposing ends to disks 44*a* and 44*b*. Disks 44*a* and 44*b* act as retainers to hold the dart chambers in position, disk 44*a* being adjacent proximal cap 20, and disk 44*b* being adjacent distal cap 30.

Figure 2:
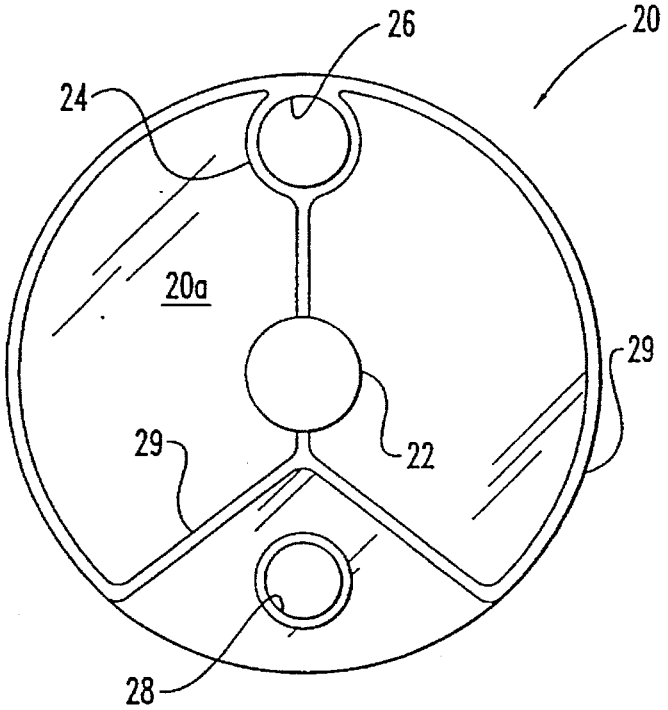
FIG. 2 is an elevational view of the proximal cap of the embodiment shown in FIG. 1 with the mouthpiece removed.

Referring to FIG. 2, the proximal cap 20 is shown in more detail with mouthpiece 50 removed for clarity. Proximal cap 20 includes a centrally located hub 22 which protrudes from proximal outer surface 20*a* similar to hub 32 and housing 38 of distal cap 30. Also, proximal cap 20 includes mouthpiece adapter tube 24 and defines air input aperture 26. In addition, proximal cap 20 defines loading aperture 28 opposite input aperture 26. Proximal outer surface 20*a* is formed with reinforcement ribs 29. In an alternative preferred embodiment, such reinforcement ribs are not required. In one preferred embodiment, proximal cap 20, mouthpiece adapter tube 24, and ribs 29 are integrally formed from a single piece of thermoplastic material.

Figure 3:
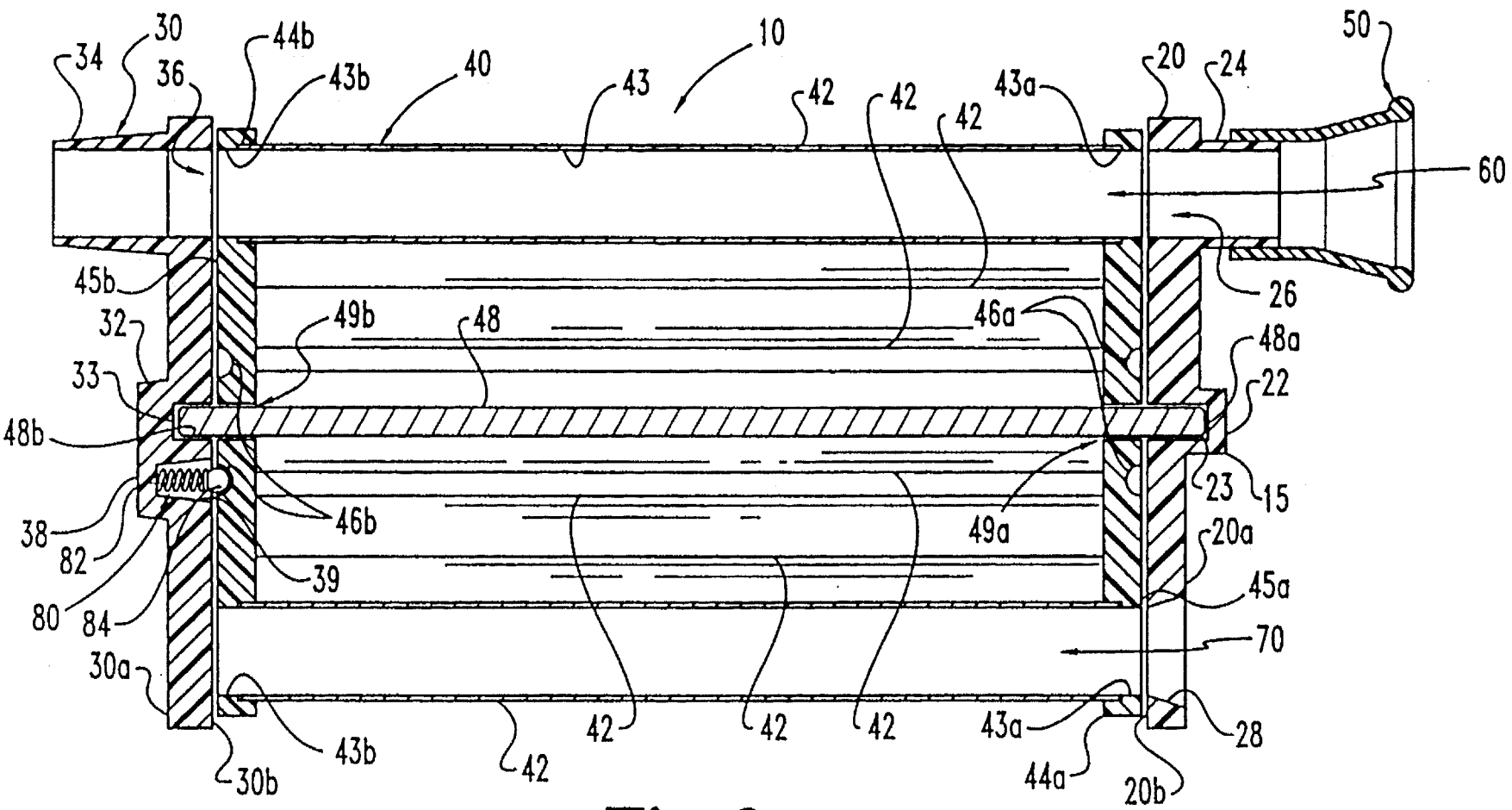
FIG. 3 is a side cross-sectioned view of the embodiment shown in FIG. 1.
Figure 5:
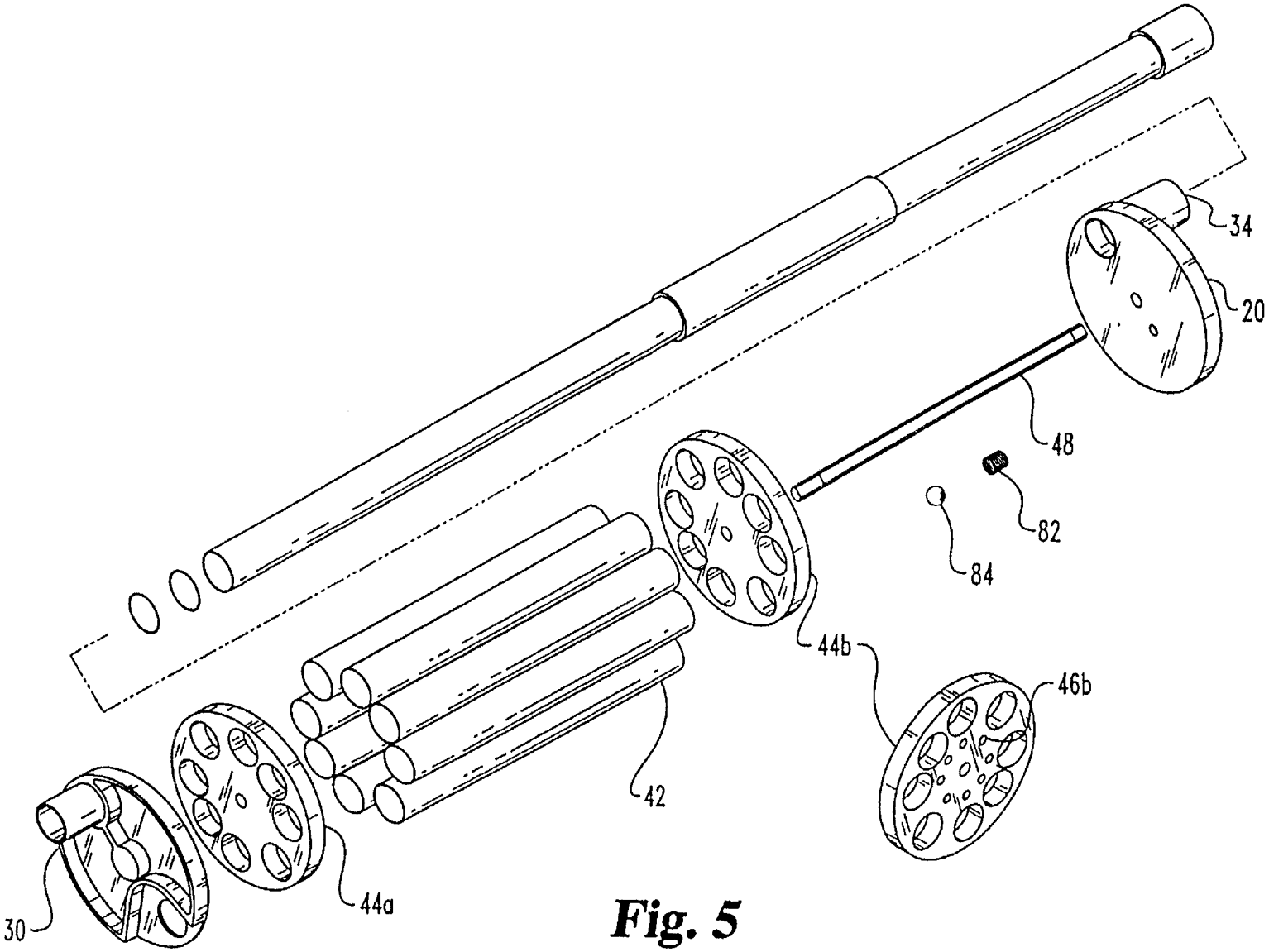
FIG. 5 is an exploded perspective view of one embodiment of the present invention.

Next, referring to FIG. 3, a cross-section of blow gun assembly 10 is shown. Specifically, it is illustrated that each dart chamber 42 is a longitudinal chamber which is generally parallel to axis L. Furthermore, for each chamber 42, an inlet 43*a* is defined by disk 44*a*, and an outlet 43*b* is defined by disk 44*b*. Each dart chamber 42 of magazine 40 has opposing first and second ends connected adjacent disks 44*a* and 44*b*, respectively.

For the dart chamber aligned with input aperture 26 and exit aperture 36, a projectile launching path 60 is defined. By forcing air through mouthpiece 50, mouthpiece adapter tube 24, inlet 43*a*, and into chamber 42, a projectile located therein is forced by the air pressure to exit outlet 43*b*, exit aperture 36 and muzzle adapter tube 34. It is envisioned that a longer blow gun barrel may be attached to muzzle adapter tube 34 to improve accuracy as would occur to those skilled in the art.

Similarly, a projectile loading path 70 is defined by the dart chamber aligned with loading aperture 28. Projectile loading path 70 provides for the loading of projectiles into each of chambers 42 through corresponding inlet 43*a*. Furthermore, for the chamber aligned with loading aperture 28, the corresponding chamber outlet 43*b* is blocked by distal inner surface 30*b* so that the projectile does not come out of the magazine until rotated to form a launching path alignment.

Figure 4:
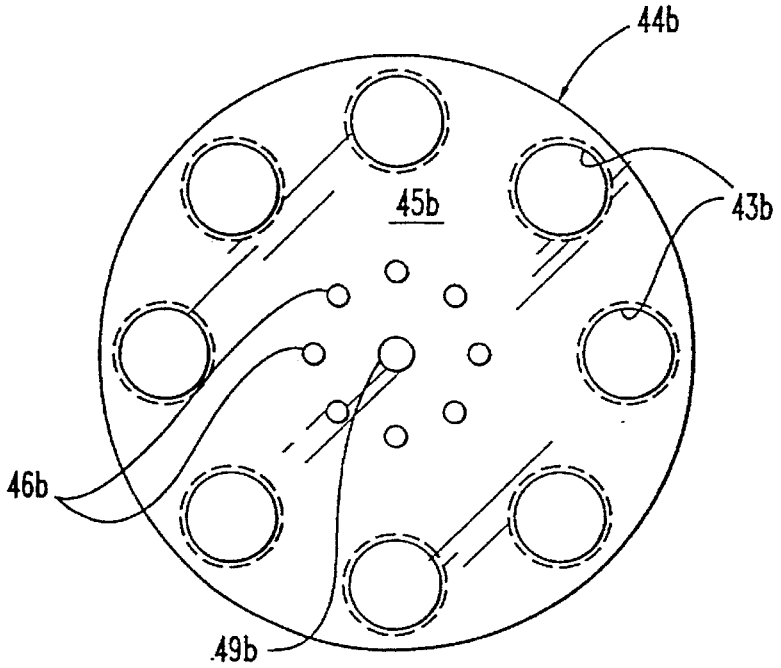
FIG. 4 is an elevational view of one of the disks shown in FIG. 1.

Referring now to FIG. 4, an elevational view of disk 44*b* is provided in more detail. Specifically, disk 44*b* is configured with eight outlets 43*b*. For the preferred embodiment shown, eight chambers 42 each with a corresponding inlet 43*a*, and outlet 43*b* are employed. In other preferred embodiments, a different number of chambers may be employed as would occur to one skilled in the art.

Disk 44*b* includes end face 45*b* which defines a number of recesses 46*b* corresponding to the number of chambers 42. Disk 44*b* also includes a central bearing aperture 49*b*. This bearing aperture is configured as a rubbing bearing to receive shaft 48 therethrough so that magazine 40 is rotably mounted along shaft 48.

Shaft 48 has distal end 48*b* opposing proximal end 48*a*. Distal end 48*b* protrudes through bearing aperture 49*b* and is rigidly secured in cavity 33 defined by hub 32 of distal cap 30. Similarly, disk 44*a* defines central bearing aperture 49*a* configured to receive proximal end 48*a* of shaft 48 therethrough, proximal end 48*a* being rigidly secured in cavity 23 defined by hub 22 of proximal cap 20. With the opposing ends of each chamber 42 connected to disks 44*a* and 44*b*, respectively, each chamber 42 along axis L, is held in an approximate parallel relationship to every other chamber 42 and is approximately evenly spaced about shaft 48.

In one preferred embodiment, disks 44*a* and 44*b* are made from a thermoplastic material, while other preferred embodiments use metal or some other suitable material. Similarly, chambers 42 may be formed from a thermoplastic material, or from metal as illustrated in the preferred embodiment of FIG. 3.

Consequently, magazine 40 is configured to be manually rotated about shaft 48 which is rigidly secured to proximal cap 20 and distal cap 30. Indeed, proximal cap 20, shaft 48, and distal cap 30 form a rigid spool 15 relative to rotation of magazine 40. By rotating magazine 40 a selected amount between proximal cap 20 portion of spool 15 and distal cap 30 portion of spool 15, each chamber 42 may be aligned to form a corresponding projectile launching path 60 or a corresponding projectile loading path 70 as desired. Furthermore, it should be noted that by rotably mounting magazine 40 along shaft 48, no other structure inhibits the rotation of magazine 40 unlike the longitudinal arms of existing designs.

Another aspect of the present invention is rotational indexer 80. Rotational indexer 80 includes a finger portion 84 and coiled spring portion 82. Indexer 80 is compressively coupled between distal cap 30 and end face 45*b* of disk 44*b*. For the preferred embodiment shown, finger 84 is a small metallic ball (a locator ball) resting on top of coiled spring 82. Distal cap 30 has indexer housing 38 which defines indexer cavity 39.

Indexer cavity 39 contains at least a portion of spring 82. Indexer finger 84 is configured to engage each of the recesses 46*b* of disk 44*b*. Spring 82 biases finger 84 to press against face 45*b*.

As magazine 40 is rotated about shaft 48, finger 84 rolls along face 45*b* along an approximately circular path intersecting recesses 46. Because finger 84 is configured with a ball shape with rolling action, scoring of face 45*b* is kept to a minimum. When magazine 40 is rotated so that a recess 46 is engaged by finger 44, an additional force is required to disengage finger 84 from the given recess. Consequently, a rotational stop results for that recess. Preferably, recesses 46*b* are configured to correspond to the number of chambers 42, and are further configured so that a rotational stop corresponds to alignment of each chamber 42 to form a projectile launching path 60 or alignment of each chamber 42 to form a projectile loading path 70. For the preferred embodiment illustrated, the rotational stops are configured to provide simultaneous alignment of projectile launching path 60 for one chamber 42 and projectile loading path 70 for another opposing chamber 42. In one preferred embodiment, grease or oil is used to lubricate the path of finger 84 along face 45*b* as well as the bearings of disks 44*a* and 44*b*. In still another preferred embodiment, indexer 80 is coupled between disk 44*a* and surface 20*b* of proximal cap 20. In this embodiment, disk 44*a* is configured similar to disk 44*b*. In variations of preferred embodiments using indexer 80, outer longitudinal arms may serve as an alternative means for connecting proximal cap 20 and distal cap 30.

Having described the configuration of one preferred embodiment of the present invention, the operation of the present invention is next discussed. Magazine 40 of blow gun assembly 10 is loaded by rotating magazine 40 until a rotational stop is encountered which aligns one chamber 42 to form a projectile loading path 70. A projectile is then inserted along path 70. Next, magazine 40 is further rotated until another rotational stop is encountered which corresponds to the alignment of an empty chamber 42 with loading aperture 28 to form a corresponding projectile loading path 70. Similarly, a projectile is loaded into this chamber 42. The remaining empty chambers 42 may be loaded by selectively rotating magazine 40 to each of the corresponding rotational stops and inserting a projectile through loading aperture 28 along projectile loading path 70.

Once the desired quantity of projectiles are loaded into chambers 42 of magazine 40, magazine 40 may be rotated until a loaded chamber 42 aligns with air input aperture 26 and exit aperture 36 to form a corresponding projectile launching path 60. The projectile is then launched by forcing air through mouthpiece 50 to provide fluid pressure in chamber 50 to launch the projectile out exit aperture 36 and through muzzle adapter tube 34, as well as any corresponding muzzle or barrel attached thereto. Launching another of the loaded projectiles is accomplished by similarly rotating magazine 40 to the next rotational stop corresponding to chamber 42 loaded with a projectile, and repeating the launching procedure.

While the invention has been illustrated and described in detail in the foregoing description, the same is to be considered as illustrative and not restrictive in character, it being understood that only the preferred embodiment has been shown and described and that all changes and modifications that come within the spirit of the invention are desired to be protected.

What is claimed is:

1. A blow gun assembly for loading a plurality of projectiles each to be launched by forcing air through the assembly, comprising:

a shaft with a proximal end and a distal end;

a proximal end cap secured to said shaft adjacent said proximal end, said proximal cap defining a projectile loading aperture and an air input aperture;

a distal end cap secured to said shaft adjacent said distal end, said distal cap defining a projectile exit aperture;

a projectile magazine rotably mounted along said shaft between said proximal and distal caps, said magazine defining a number of projectile-holding chambers;

wherein selectively revolving said magazine about said shaft aligns each of said number of chambers with said loading aperture to define a corresponding projectile loading path and aligns each of said number of chambers with said input and exit apertures to define a corresponding projectile launching path.

2. The assembly of claim 1, and further comprising a muzzle adapter tube aligned with said exit aperture and connected to said distal cap, a mouthpiece adapter tube aligned with said air input aperture and connected to said proximal cap, and a mouthpiece coupled to said mouthpiece adapter tube.

3. The assembly of claim 1, and further comprising:

(a) an end face coupled to said projectile magazine, said end face defining a number of recesses corresponding to said number of chambers; and (b) a spring-loaded indexer coupled between said end face and one of said proximal and distal caps, said indexer including a finger configured to engage each of said number of recesses to provide a corresponding number of rotational stops, wherein each of said rotational stops corresponds to alignment of one of said number of chambers with said input and exit apertures.

4. The assembly of claim 3, wherein each of said rotational stops further corresponds to the simultaneous alignment of another of said number of chambers with said loading aperture.

5. The assembly of claim 3, wherein said indexer includes a spring portion; and wherein the end cap coupled to said indexer defines a cavity containing said spring portion with said finger protruding therefrom.

6. The assembly of claim 1, wherein selectively revolving said magazine about said shaft simultaneously aligns one of said number of chambers with said loading aperture and simultaneously aligns another of said plurality of chambers with said input and exit apertures.

7. The assembly of claim 1, wherein said magazine has:

a plurality of dart chambers oriented along a longitudinal axis;

a first disk connected to each of said plurality of chambers, said first disk having a first central aperture configured as a rotational bearing and rotably mounted along said shaft.

8. The assembly of claim 7, wherein:

each of said plurality of chambers has a first end opposing a second end, and said first disk is connected to each of said plurality of chambers adjacent said first end;

a second disk connected to each of said plurality of chambers adjacent said second end, said second disk defining a second central aperture configured as a rotational bearing and rotably mounted along said shaft.

9. The assembly of claim 8, wherein said proximal cap defines a proximal hub cavity securing said proximal end of said shaft therein and said distal cap defines a distal hub cavity securing said distal end of said shaft therein.

10. The assembly of claim 9, wherein:

said plurality of chambers exceeds six, each of said plurality of chambers is generally cylindrical in shape and made of metal, each of said first and second disks is generally circular in shape and formed from a thermoplastic compound, each of said proximal and distal caps is formed from a thermoplastic compound, said shaft is made of metal and is the only structure connecting said proximal and distal caps, said magazine has an end face defining a number of recesses corresponding to said number of chambers; and further comprising:

a spring-loaded indexer coupled between said end face and said distal cap, said indexer including a finger configured to engage each of said number of recesses to provide a corresponding number of rotational stops, each of said number of rotational stops corresponding to alignment of one of said number of chambers with said input and exit apertures and simultaneous alignment of another of said number of chambers with said loading aperture;

a muzzle adapter tube aligned with said exit aperture and connected to said distal cap;

a mouthpiece adapter tube aligned with said air input aperture and connected to said proximal cap; and a detachable mouthpiece coupled to said mouthpiece adapter tube.

11. A blow gun assembly for loading a plurality of projectiles each to be launched by forcing air through the assembly, comprising:

a proximal cap defining a projectile loading aperture and an air input aperture;

a distal cap defining a projectile exit aperture;

a projectile magazine defining a number of chambers configured to receive one of the plurality of projectiles, said magazine having an end face defining a number of recesses corresponding to said number of chambers;

a means for connecting said proximal cap to said distal cap and rotably mounting said magazine between said proximal and distal caps so that each of said number of chambers aligns with said loading aperture to define a projectile loading path and each of said number of chambers aligns with said input and exit apertures to define a projectile launching path when said magazine is selectively rotated;

a spring-loaded indexer coupled between said end face and one of said proximal and distal caps, said indexer including a finger configured to engage each of said number of recesses to provide a corresponding number of rotational stops.

12. The assembly of claim 11, wherein said means is a shaft connecting said distal and proximal caps, and said magazine is rotably mounted along said shaft.

13. The assembly of claim 11, wherein said one of said proximal and distal caps coupled to said indexer is said distal cap.

14. The assembly of claim 11, wherein each of said number of rotational stops corresponds to alignment of one of said number of chambers with said input and exit apertures, and simultaneous alignment of another of said number of chambers with said loading aperture.

15. The assembly of claim 11, wherein said indexer includes a spring portion and one of said distal and proximal caps coupled to said indexer defines a cavity containing said spring portion with said finger protruding therefrom.

16. A blow gun assembly, comprising: (a) a projectile magazine defining a plurality of chambers, each chamber having a proximal end and a distal end, said chambers being rotatable around a first axis;

(b) a first end cap adjacent to said proximal end, including an air input aperture and a projectile loading aperture;

(c) a second end cap adjacent to said distal end, including a projectile exiting aperture;

wherein said first end cap and said second end cap are aligned such that when a projectile firing axis is defined by said air input aperture, one of said projectile magazine chambers and said projectile exiting aperture, a projectile loading axis is simultaneously defined by said projectile loading aperture and another of said projectile magazine chambers.

* * * * *